US006086324A

United States Patent [19]

Ikeda et al.

[11] Patent Number: 6,086,324

[45] Date of Patent: Jul. 11, 2000

[54] CROSS FLOW FAN

[75] Inventors: Takashi Ikeda; Makoto Yoshihashi; Katsumi Ohashi; Sou Suzuki; Satoshi Chiguchi; Hiroshi Yoshikawa, all of Tokyo, Japan

[73] Assignee: Mitsubishi Denki Kabushiki Kaisha, Tokyo, Japan

[21] Appl. No.: 09/161,760

[22] Filed: Sep. 29, 1998

[30] Foreign Application Priority Data

Jan. 19, 1998 [JP] Japan ..... 10-007529

[51] Int. Cl.[7] ..... F04D 17/04

[52] U.S. Cl. ..... 415/53.1; 415/119

[58] Field of Search ..... 415/53.1, 53.2, 415/53.3, 119; 165/122, 135, 151

[56] References Cited

U.S. PATENT DOCUMENTS

| | | | |
|---|---|---|---|
| 3,695,775 | 10/1972 | Zenkner | 415/53.1 |
| 4,014,625 | 3/1977 | Yamamoto | 415/53.1 |
| 5,094,586 | 3/1992 | Takada et al. | 415/53.3 |
| 5,564,495 | 10/1996 | Yoshihashi et al. | 165/122 |
| 5,673,747 | 10/1997 | Kousaka et al. | 415/53.1 |
| 5,943,878 | 8/1999 | Smiley, III et al. | 415/53.1 |

FOREIGN PATENT DOCUMENTS 60-233392 11/1985 Japan .

*Primary Examiner*—Christopher Verdier
*Attorney, Agent, or Firm*—Burns, Doane, Swecker & Mathis, LLP

[57] ABSTRACT

A cross flow having a volute is disclosed which is less noisy during its operation. A volute-portion starting radius which is the length of a segment O–$F_1$ at a volute-portion starting point $F_1$ is $R_1$; a maximum volute radius which is the length of a segment O–$F_2$ at the outlet portion starting point $F_2$ is $R_M$; a maximum volute angle which is an angle formed by the segment O–$F_2$ and O–$F_1$ is M; a point on the volute portion having a distance to the center O of the rotating shaft is $R_J=(R_1+R_M)/2$; an angle $_J$ is formed by a segment connecting that point and the center 0 of the rotating shaft; the segment O–$F_1$ is $_M/2$ (=$F_1$–O–$F_J$); a volute portion of a scroll casing is formed into a circular arc such that $R_1<R_J<R_M$, and the circular arc passes through the points $F_1$, $F_J$, and $F_2$.

6 Claims, 13 Drawing Sheets

21 : CIRCULATING VORTEX

1 : MAIN BODY OF AN AIR CONDITIONER
2 : HOUSING
3 : PANEL
4 : FRONT AIR INLET GRILLE
5 : UPPER AIR INLET GRILLE
6 : AIR OUTLET

7 : HEAT EXCHANGER
8 : CROSS FLOW FAN
10 : SCROLL CASING
11 : STABILIZER
12 : AIR-OUTLET LOWER GUIDE
13 : AIR-OUTLET UPPER GUIDE
14 : OUTLET DUCT
15 : UP/DOWN BLOWING-DIRECTION CHANGING PLATE
16 : LEFT/RIGHT BLOWING-DIRECTION CHANGING PLATE
17 : DUST REMOVING FILTER
18 : AIR CLEANING FILTER
19 : DRAIN PAN
22 : ROOM

21 : CIRCULATING VORTEX

CROSS FLOW FAN

BACKGROUND OF THE INVENTION

1. Field of the Invention

The present invention relates to a cross flow fan provided as a blowing means for such as an air conditioner.

2. Related Art

FIGS. 18 to 22 are diagrams illustrating examples of air conditioners in which cross flow fans 8 are mounted. FIG. 18 is a perspective view of a main body 1 of an air conditioner in which an upper air inlet grille 5 is not disposed on the rear surface side of a round starting point $F_0$ of a scroll casing 10, and FIG. 19 is a cross-sectional view, taken along a plane X in the direction of arrow L, of the main body 1 of the air conditioner in FIG. 18. FIG. 20 is a perspective view of the main body 1 of the air conditioner in which the upper air inlet grille 5 is disposed on the rear surface side of the round starting point $F_0$ of the scroll casing 10, and FIG. 21 is a cross-sectional view, taken along the plane X in the direction of arrow L, of the main body 1 of the air conditioner in FIG. 20. FIG. 22 is a diagram illustrating the flow of air in FIG. 21.

In FIG. 18, the main body 1 of the air conditioner forms a casing which is comprised of a housing 2, which is located on the rear surface side of main body 1 of the air conditioner, as well as a panel 3 having a rotatable openable and detachable front air inlet grille 4 and the upper air inlet grille 5. Further, an air outlet 6 is formed by the housing 2 and the panel 3.

In FIG. 19, reference numeral 7 denotes a heat exchanger which is bent in a chevron shape which is disposed on the front surface side of main body 1 of the air conditioner with respect to the round starting point $F_0$, which is a starting point of the scroll casing 10. Numeral 19 denotes a drain pan for receiving drain water produced an air is condensed by the heat exchanger 7. Numeral 17 denotes a dust removing filter for removing dust in the air sucked into the main body 1 of the air conditioner. Numeral 18 denotes an air cleaning filter for cleaning air by means of activated carbon.

A section of the housing 2 which extends from its portion close to the rear surface portion to its lower portion is formed by the scroll casing 10 and an air-outlet lower guide 12 continuing and extending from the scroll casing 10. A none section is formed by the drain pan 19, a stabilizer 11, and an air-outlet upper guide 13. An outlet duct 14 is a portion surrounded by the air-outlet upper guide 13, the air-outlet lower guide 12, and the panel 3, and is a portion for guiding the air flow from the cross flow fan 8 into the air outlet 6. The cross flow fan 8 is formed by an impeller 9, the scroll casing 10, and the outlet duct 14.

In the main body 1 of the air conditioner thus constructed, as the impeller 9 of the cross flow fan 8 rotates about the center O of the rotating shaft of the impeller in the direction of arrow A as shown in FIG. 19, a circulating vortex 21 in induced and produced, and the impeller 9 sucks air and starts blowing the air. As a result, air is sucked from the front air inlet grille 4 and the upper air inlet grille 5. Then, as indicated by arrow B, after the air passes through the dust removing filter 17 and part of the air passes through the air cleaning filter 16, the air is subjected to heat exchange by the heat exchanger 7, and is sucked into the impeller 9 of the cross flow fan 8. Subsequently, the air C blown out from the impeller 9 of the cross flow fan 8 is collected directly or by the scroll casing 10, and passes through the outlet duct 14. After the blowing direction is regulated appropriately by a left/right blowing-direction changing plate 16 and up/down blowing-direction changing plates 15, the air is then supplied from the air outlet 6 to a room 22 to air-condition the room 22.

FIGS. 20 and 21 are diagrams illustrating an example of the air conditioner in which, in contrast to the above-described air conditioner, the area of the heat exchanger 7 is increased, and the upper air inlet grille 5 in disposed also on the rear surface side of the round starting point $P_0$ so as to attain high performance of the air conditioner. The operation is similar to that of the air conditioner shown in FIG. 19.

With the air conditioner having the above-described cross flow fan 8, when the air in blown out from the impeller 9 of the cross flow fan 8, since the upper air inlet grille 5 is disposed also on the rear surface side of the round starting point $F_0$ of the scroll casing 10 the blown-out air flow C impinges upon the scroll casing 10 in the vicinity of the impeller 9, and pressure fluctuation P occurs in this portion. Consequently, the phenomenon takes place in which noise is aggravated an the vanes of the impeller 9 pass through the section of the pressure fluctuation P, and this phenomenon has been a problem.

SUMMARY OF THE INVENTION

The present invention has been devised to overcome the above-described problem, and its object in to obtain a cross flow fan which produces small noise during its operation.

In accordance with the present invention, there is provided a cross flow fan comprising: an impeller having a center O of a rotating shaft and a diameter of $\phi D$; a scroll casing including a round starting portion extending from a round starting point $F_0$ to a volute-portion starting point $F_1$, a volute portion extending from the volute-portion starting point $F_1$ to an outlet-portion starting point $F_2$, and an outlet portion extending from the outlet-portion starting point $F_2$ to an outlet-portion terminating point $F_3$; a nose section having a stabilizer; and an air inlet disposed outwardly of the round starting point $F_0$, wherein the round starting portion is formed into a circular arc which has the center O of the rotating shaft as its center and in which a round starting angle $\alpha_0$ formed by a segment O–$F_0$ and a segment O–$F_1$ is equal to 15° to 25°, and a round starting radius $R_0$, i.e., a length of a segment connecting the round starting point $F_0$ and the center O of the rotating shaft, is equal to 0.535 to $0.555\times\phi D$, and wherein if it is assumed that a volute-portion starting radius, i.e., the length of the segment O–$F_1$ at the volute-portion starting point $F_1$, is $R_1$, that a maximum volute radius, i.e., a length of a segment O–$F_1$ at the outlet-portion starting point $F_2$, is $R_M$, that a maximum volute angle, i.e., an angle formed by the segment O–$F_2$ and the segment O–$F_1$, is $\alpha_M$, and that such a point on the volute portion that its distance to the center O of the rotating shaft in $R_J=(R_1+R_M)/2$ and an angle $\alpha_J$ formed by, on the one hand, a segment connecting that point and the center O of the rotating shaft and, on the other hand, the segment O–$F_1$ is $\alpha_M/2$ (=$F_1$–O–$F_J$) is $F_J$, the volute portion is formed into such a circular arc that $R_1<R_J<R_M$, and that the circular arc passes through the points $F_1$, $F_J$, and $F_2$.

In addition, there is provided a cross flow fan comprising: an impeller having a center O of a rotating shaft and a diameter of $\phi D$; a scroll casing including a round starting portion extending from a round starting point $F_0$ to a volute-portion starting point $F_1$, a volute portion extending from the volute-portion starting point $F_1$ to an outlet-portion starting point $F_2$, and an outlet portion; a nose section having a stabilizer; and an air inlet disposed outwardly of the round starting point $F_0$, wherein the round starting portion is formed into a circular arc which has the center O of the rotating shaft as its center and in which a round starting angle $\alpha_0$ formed by a segment O–$F_0$ and a segment O–$F_1$ is equal to 15° to 25°, and a round starting radius $R_0$, i.e., a length of a segment connecting the round starting point $F_0$ and the center O of the rotating shaft, is equal to 0.535 to 0.555×ϕD, and wherein it is assumed that a length of a segment O–F connecting the center O of the rotating shaft and an arbitrary point F on the volute portion is an arbitrary radius R, that an angle formed by the segment O–F and the segment O–$F_1$ is α, and that a maximum volute angle formed by the segment O–$F_2$ and the segment O–$F_1$ is $\alpha_M$, the volute portion is formed into a logarithmically spiral shape satisfying the formula: $R=R_1\times EXP(I_L\times 2\times\pi\times a/360°)$ where $I_L$ (scroll expansion ratio)=0.18 to 0.23; $O<\alpha<\alpha_M$; and $\alpha_M$=60 to 90°.

In addition, the outlet portion has an air-outlet lower guide, and is formed much that a passage of air flow expands toward the air-outlet lower guide.

In addition, if an outlet-portion starting radius, i.e., the length of the segment O–$F_2$ connecting the center O of the rotating shaft and the outlet-portion starting point $F_2$, is $R_2$, that an outlet-portion terminating radius, i.e., the length of the segment O–$F_3$ connecting the center O of the rotating shaft and the outlet-portion terminating point $F_3$, is $R_3$, and that an angle $F_2$–O–$F_3$ is an outlet portion angle $\alpha_3$, the outlet portion in formed into such a circular arc that $R_1<R_3$, $R_3/R_2$=1.1 to 1.8×ϕD/2, and $a_3$=125° to 145°, and the circular arc contacts the air-outlet lower guide at the outlet-portion terminating point $F_3$.

The present disclosure claims priority under 35 U.S.C. 119 for all of the subject matter disclosed in Japanese patent application No. Hui. 10-7529 (filed on Jan. 19, 1998) which is expressly incorporated herein by reference in its entirety, all essential material having been set forth in the present specification.

BRIEF DESCRIPTION OF THE DRAWINGS

In the accompanying drawings

DETAILED DESCRIPTION OF THE PREFERRED EMBODIMENTS

First Embodiment

Hereafter, a description will be given of a first embodiment with reference to the drawings.

Figure 1:
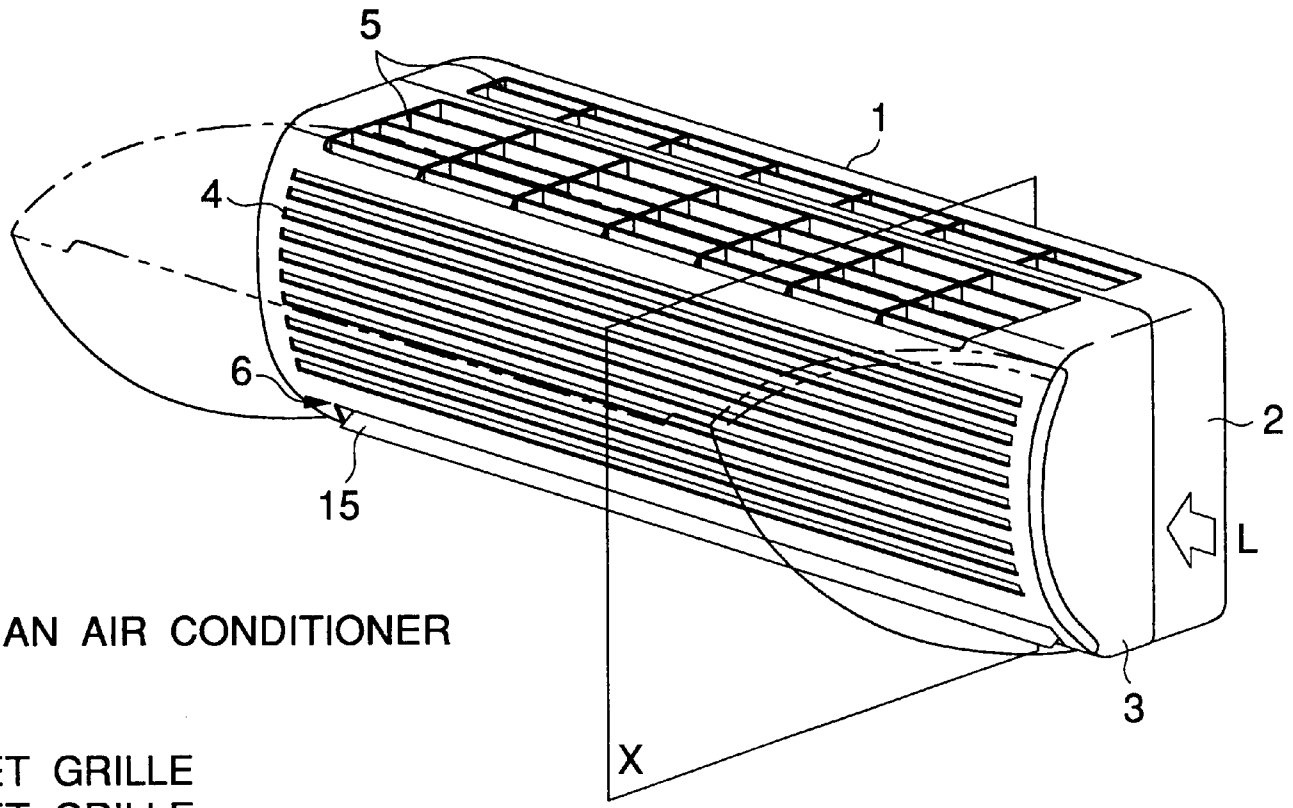
FIG. 1 is a perspective view of the main body of an air conditioner in accordance with a first embodiment of the present invention.
Figure 2:
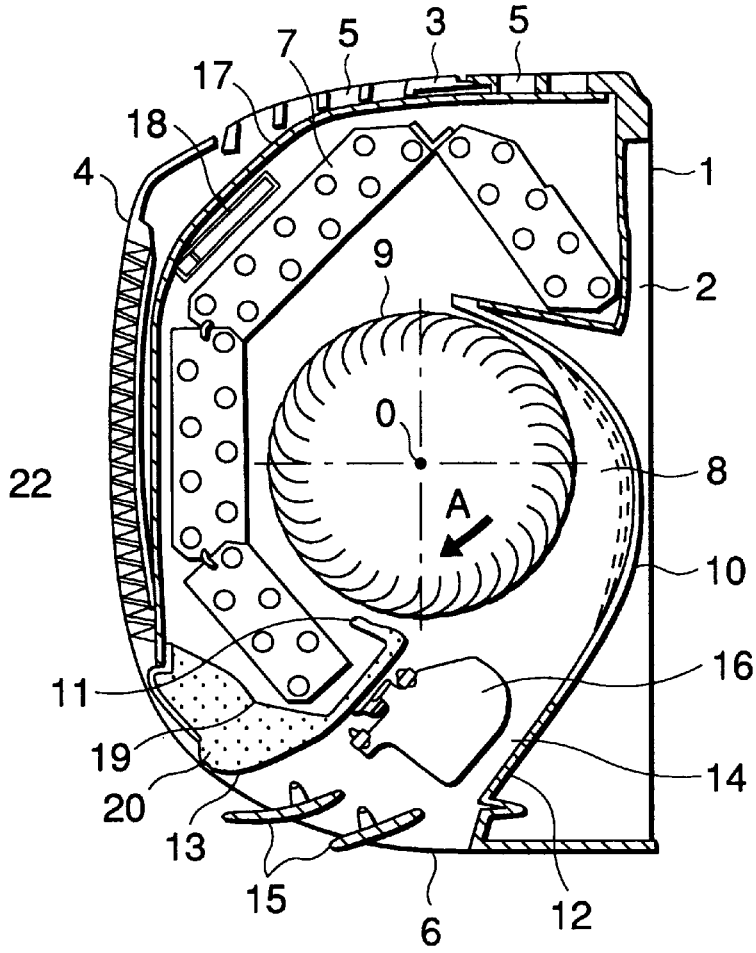
FIG. 2 is a cross-sectional view, taken along a plane X in the direction of arrow L, of the main body of the air conditioner in FIG. 1.
Figure 3:
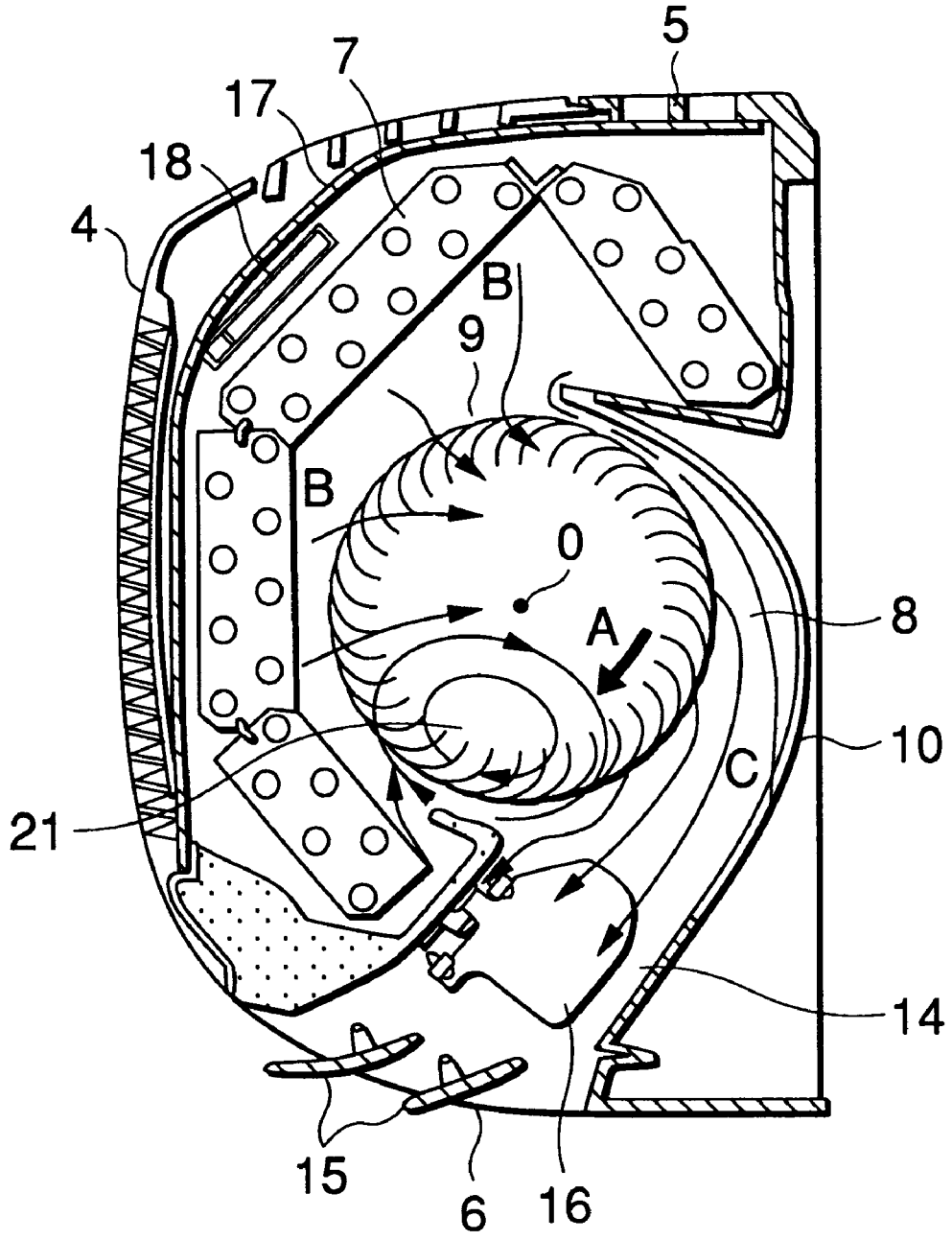
FIG. 3 is a diagram illustrating the flow of air in FIG. 2.
Figure 4:
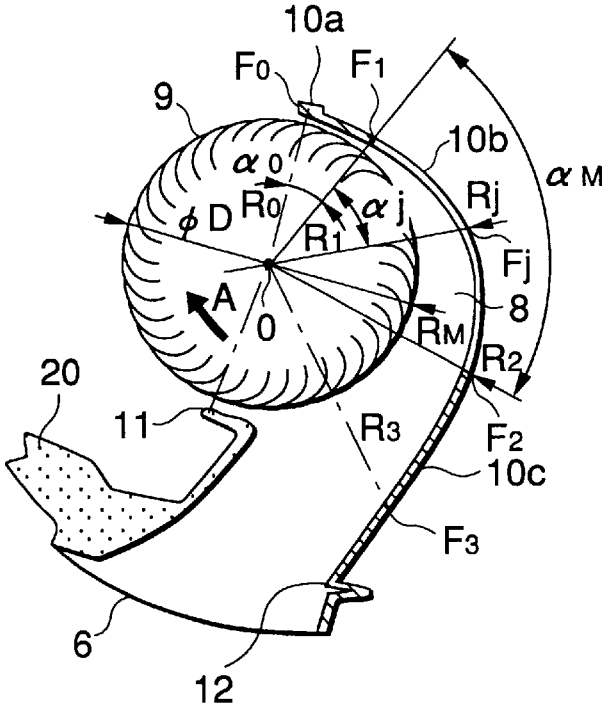
FIG. 4 in a diagram of the cross flow fan removed in FIG. 3.

FIG. 1 is a perspective view of the main body 1 of an air conditioner in accordance with the first embodiment of the present invention. FIG. 2 is a cross-sectional view, taken along a plans X in the direction of arrow L, of the main body 1 of the air conditioner in FIG. 1. FIG. 3 is a diagram illustrating the flow of air in FIG. 2, and FIG. 4 is a diagram of the cross flow fan removed in FIG. 3.

In FIG. 1, the main body 1 of the air conditioner forms a casing which is comprised of a housing 2 and a panel 3, which are both provided with upper air inlet grilles 5 respectively disposed on the front surface side and the rear surface side of a round starting point $F_0$ of a scroll casing 10, a rotatably openable front air inlet grille 4 being fitted to the panel 3.

Figure 19:
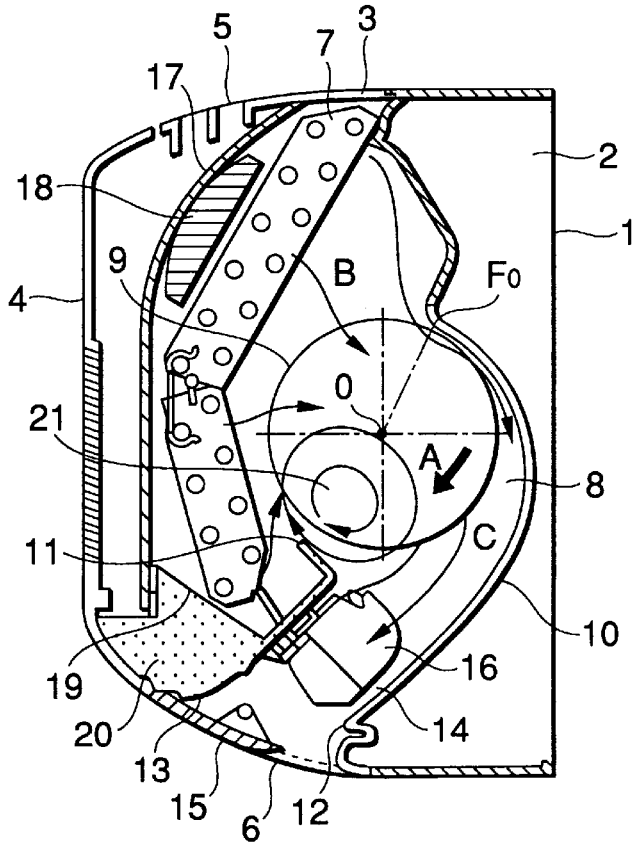
FIG. 19 is a cross-sectional view, taken along a plane X in the direction of arrow L, of the main body of the air conditioner in FIG. 18.
Figure 20:
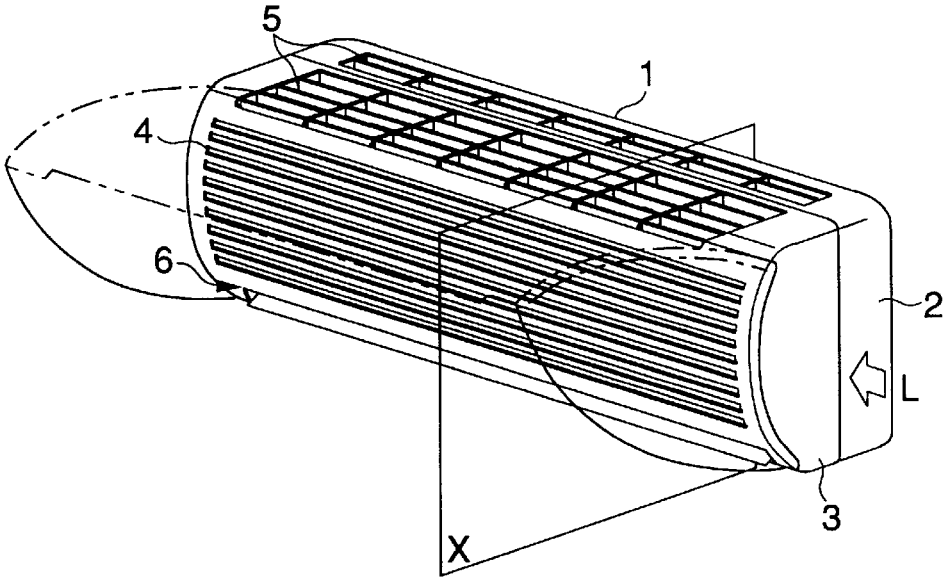
FIG. 20 is a perspective view of the main body of the air conditioner in which the upper air inlet grille is disposed on the rear surface side of the round starting point of a scroll casing.
Figure 21:
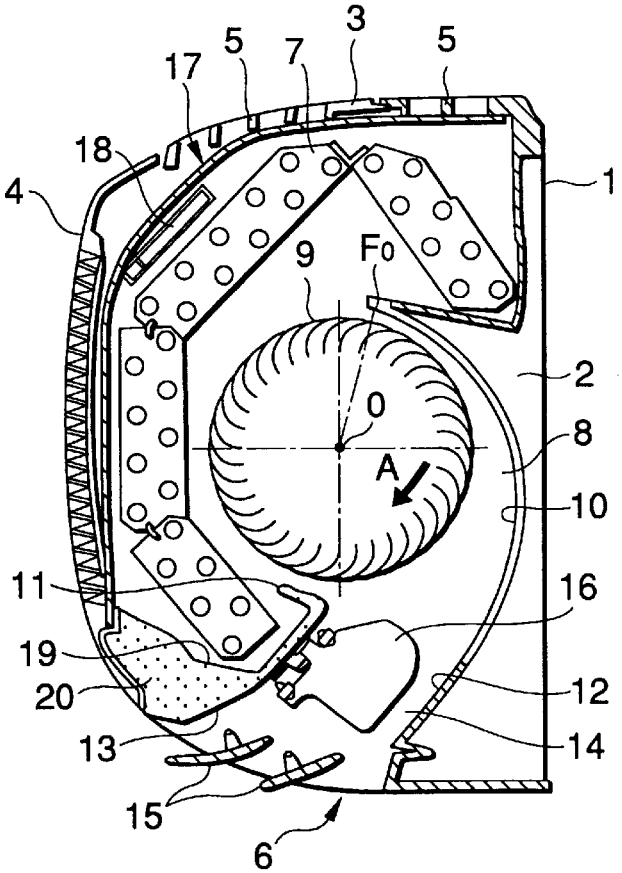
FIG. 21 is a cross-sectional view, taken along the plane X in the direction of arrow L, of the main body of the air conditioner in FIG. 20.
Figure 22:
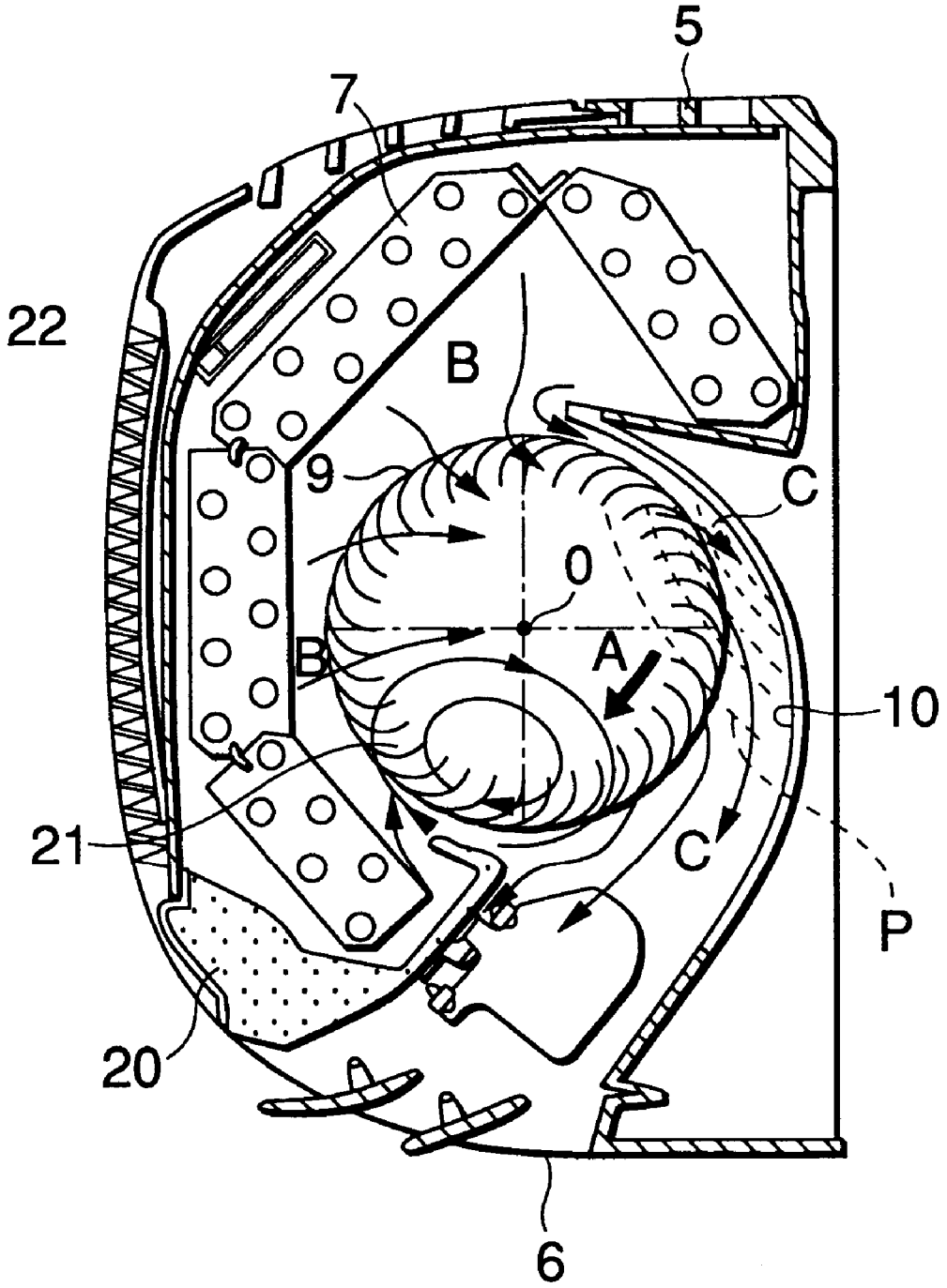
FIG. 22 is a diagram illustrating the flow of air in FIG. 21.

In FIG. 19, reference numeral 7 denotes a heat exchanger which is bent in a plurality of stages. Numeral 19 denotes a drain pan for receiving drain water produced as air is condensed by the heat exchanger 7. Numeral 17 denotes a dust removing filter for removing dust in the air sucked into the main body 1 of the air conditioner. Numeral 18 denotes an air cleaning filter for cleaning air by means of activated carbon. A section of the housing 2 which extends from its portion close to the rear surface portion to its lower portion is formed by the scroll casing 10 and an air-outlet lower guide 12 continuing and extending from the scroll casing 10. A nose section is formed by the drain pan 19, a stabilizer 11, and an air-outlet upper guide 13. An outlet duct 14 is a portion surrounded by the air-outlet upper guide 13, the air-outlet lower guide 12, and the panel 3, and is a portion for guiding the air flow from the cross flow fan 8 into the air outlet 6. The cross flow fan 8 is formed by an impeller 9, the scroll casing 10, and the outlet duct 14.

In the main body 1 of the air conditioner thus constructed, as the impeller 9 of the cross flow fan 8 rotates about the center O of the rotating shaft of the impeller in the direction of arrow A as shown in FIG. 3, air is sucked from the front air inlet grille 4 and the upper air inlet grille 5. Then, as indicated by arrow X, after the air passes through the dust removing filter 17 and part of the air passes through the air cleaning filter 19, the air is subjected to heat exchange by the heat exchanger 7, and is sucked into the impeller 9 of the cross flow fan 8. Subsequently, the air C blown out from the impeller 9 of the cross flow fan 8 is collected directly or by the scroll casing 10, and passes through the outlet duct 14. After the blowing direction is regulated appropriately by a left/right blowing-direction changing plate 16 and up/down blowing-direction changing plates 15, the air is then supplied from the air outlet 6 to a room 22.

In FIG. 4, the impeller 9 of the cross flow fan 8 is shown as having an outside diameter of $\phi D$, and the stabilizer 11 of the nose section 20 is shown. In addition, the scroll casing 10 is formed by a round starting portion 10*a*, a volute portion 10*b*, and an outlet portion 10*c*.

In the round starting portion 10, it is now assumed that the length of a segment $O–F_0$ connecting the center O of the rotating shaft of the impeller and the round starting point $F_0$, i.e., the point at the round starting portion 10*a* closest to the impeller 9, is a round starting radius $R_0$, that the distance between the center O of the rotating shaft of the impeller and a volute-portion starting point $F_1$, i.e., a terminating point of the round starting portion 10*a* and a starting point of the volute portion 10*b*, is a volute-portion starting radius $R_1$, and that an angle $F_0–O–F_1$ formed by the segments $O–F_0$ and $O–F_1$ is a round starting angle $\alpha_0$. Under this assumption, the round starting portion 10*a* is formed into a circular arc whose round starting radius $R_0$ is equal to $R_1$ with the center O of the rotating shaft of the impeller set as its center, as shown in FIG. 4.

Figure 5:
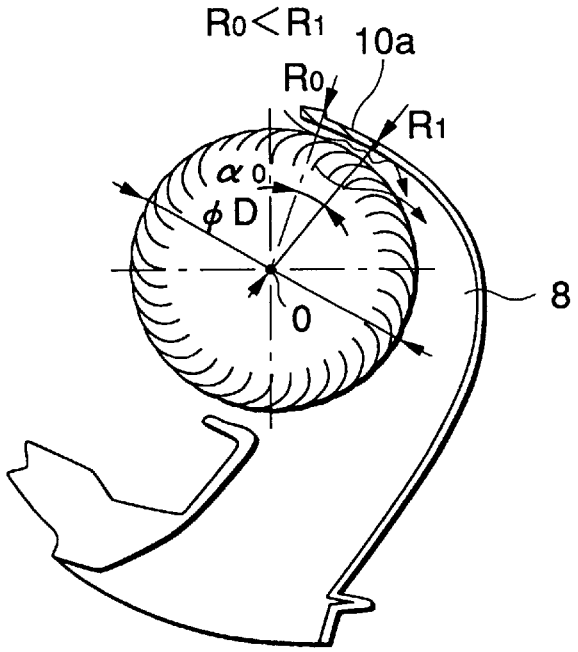
FIG. 5 is a diagram in a case where the interval between an impeller and a round starting portion is too wide.
Figure 6:
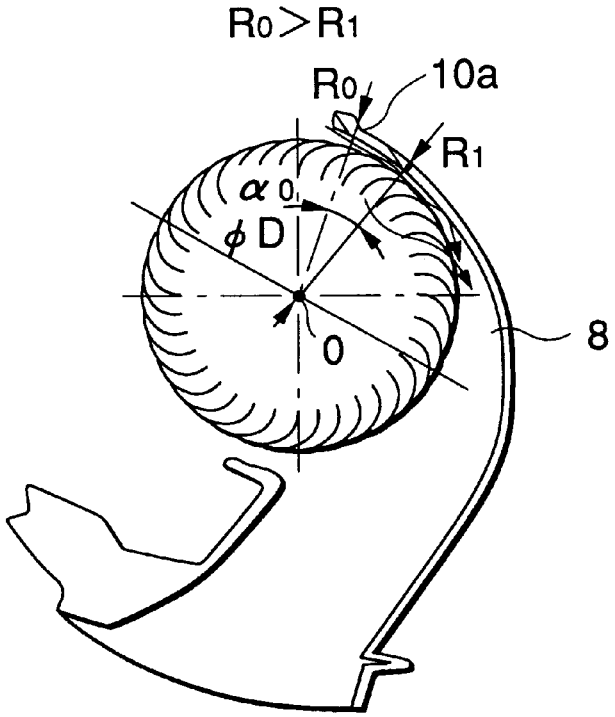
FIG. 6 is a diagram in a case where the interval between the impeller and the round starting portion is too narrow.

If $R_0<R_1$ as shown in FIG. 5, the interval between the impeller 9 and the round starting portion 10*a* becomes too wide, so that the blown-out air flow becomes unstable and noise becomes aggravated. Meanwhile, if $R_0>R_1$ as shown in FIG. 6, the interval between the impeller 9 and the round starting portion 10*a* becomes too narrow, so that the blown-out air flow becomes blocked, deteriorating the air supplying characteristic.

Further, if the round starting angle $\alpha_0$ is too large or too small, even if the round starting portion 10*a* is circularly arcuate, the blown-out air flow becomes unstable and noise becomes aggravated. In addition, the blown-out air flow becomes blocked, deteriorating the air supplying characteristic. Accordingly, an optimum range is present for the round starting angle $\alpha_0$.

In addition, if the round starting radius $R_0$ is small, the impeller 9 and the round starting portion are too close, and the NZ noise which is the rotating noise is produced, which in unpleasant to the ear, and the noise becomes aggravated. If the impeller 9 and the round starting portion are too distant from each other, the air supplying characteristic of the impeller 9 becomes aggravated, and since air is supplied at the same flow rate, the noise becomes large. Accordingly, an optimum range is present for the round starting radius $R_0$ as well.

Figure 7:
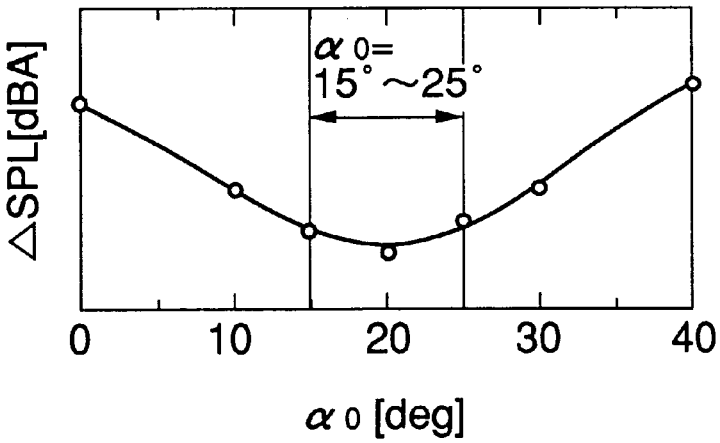
FIG. 7 is a diagram illustrating the relationship between a round starting angle and a change in the noise level at the same flow rate in a case where the round starting portion is a circular arc.

FIG. 7 shown a change $\Delta$SPL [dBA] in the noise level at the same flow rate Q [$m^3$/min] in a case where the round starting angle $\alpha_0$ is varied when the round starting portion 10*a* is a circular arc with $R_0=R_1$. Accordingly if the round starting angle $\alpha_0$ is in the range of 15°–25°, the aggravation of noise and the change in the noise are small, and the blown-out air flow is stable.

Figure 8:
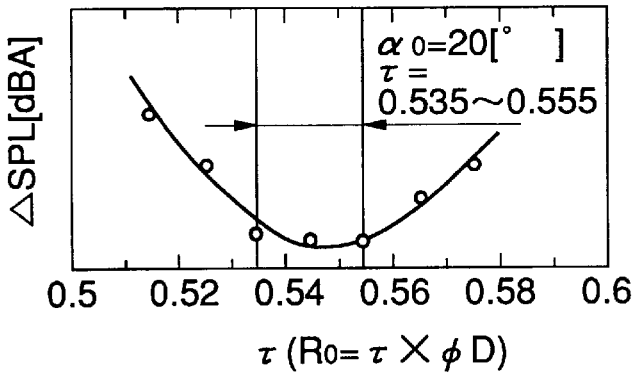
FIG. 8 is a diagram illustrating the relationship between a round starting radius and a change in the noise level at the same flow rate and at a certain round starting angle.

FIG. 8 shows the change $\Delta$SPL in the noise level at the same flow rate in a case where the round starting radius $R_0$ is varied when $a_0$ is equal to, for example, 20°, which falls within the optimum range of $a_0$ in FIG. 7. It can be appreciated from the graph that if the round starting radius is in such a range that $R_0$ =0.535 to 0.555×$\phi$D ($\phi$D=diameter of the impeller), the change in the noise is small, and the behavior is stable.

In addition, in the volute portion 10*b* in FIG. 4, it is now assumed that an outlet-portion starting point, i.e., a terminating point of the volute portion 10*b* and a starting point of the outlet portion 10*c*, is $F_2$, that the volute-portion starting radius, i.e., the length of the segment $O–F_1$ at the volute-portion starting point $F_1$, is $R_1$, that a maximum volute radius, i.e., the length of the segment $O–F_2$ at the outlet-portion starting point $F_1$, is $R_M$, that a maximum volute angle, i.e., an angle formed by the segments $O–F_2$ and $O–F_1$, is $\alpha_M$, and that such a point on the volute portion 10*b* that its distance to the center O of the rotating shaft is $R_J=(R_1+R_M)/2$ and an angle $\alpha_J$ formed by, on the one hand, a segment connecting that point and the center O of the rotating shaft and, on the other hand, the segment $O–F_1$ is $a_M/2$ ($=F_1–O–F_J$) is $F_J$. Under this assumption, the volute portion 10*b* is formed into such a circular arc that $R_1<R_J<R_M$, and it passes through the three points $F_1$, $F_J$, and $F_2$. It should be noted that an example of a circular arc is shown in this embodiment.

By forming the volute portion 10*b* in the above-described manner, the volute portion 10*b* bulges more outwardly than in the case of the example one indicated by the broken lines in FIG. 2, and the portion of the blown-out air flow C where the velocity of air flow is fast does not contact the scroll casing 10 at least in the vicinity of the impeller 9, as shown in FIG. 3. Therefore, the phenomenon disappears in which the pressure fluctuation P, which occurs due to the impingement of the blown-out air flow C upon the scroll casing 10 in the vicinity of the impeller 9, affects the impeller 9 and aggravates the noise. Hence, low noise can be attained.

Figure 9:
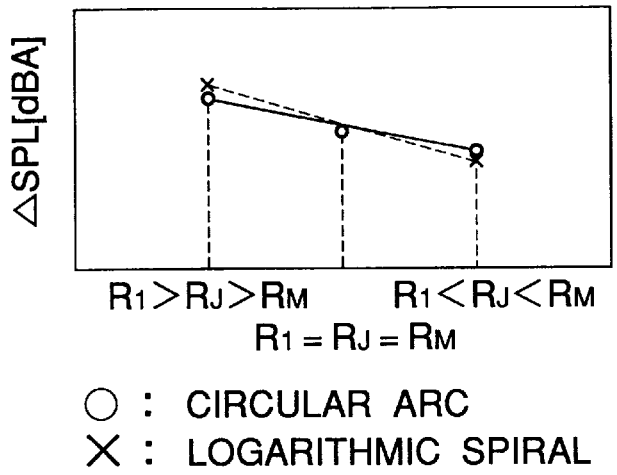
FIG. 9 is a diagram illustrating a change in the noise level with respect to the relative relationship among a volute-portion starting radius, a point on the volute portion, and a maximum volute radius at the same flow rate.
Figure 10:
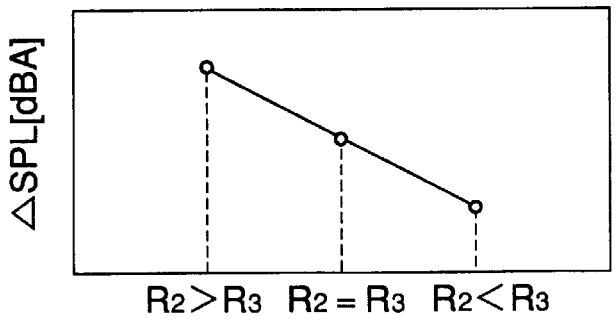
FIG. 10 is a diagram illustrating a change in the noise level with respect to the relative relationship among an outlet-portion starting radius and an outlet-portion terminating radius at the same flow rate.

FIG. 9 shows the relationship of the change $\Delta$SPL in the noise level with respect to the relationship among $R_1$, $R_J$, and $R_M$ at the same flow rate. It can be seen that if $R_1<R_J<R_M$ as shown in FIG. 9, the noise is low.

Further, in the outlet portion 10*c* in FIG. 4, it is now assumed that an outlet-portion starting radius, i.e., the length of the segment $O–F_2$ connecting the center O of the rotating shaft and the outlet-portion starting point $F_2$, is $R_2$ ($=R_M$) that an outlet-portion terminating radius, i.e., the length of the segment $O–F_3$ connecting the center O of the rotating shaft and an outlet-portion terminating point $F_3$, is $R_3$, and that the angle $F_2$–O–$F_3$ is an outlet portion angle $\alpha_3$. Under this assumption, in a comparison at the same flow rate, if the outlet portion 10*c* is formed which is enlarged gradually from the volute portion 10*b* in such a manner as to become a circular arc which passes through the outlet-portion starting point $F_2$ and the outlet-portion terminating point $F_3$ and contacts the air-outlet lower guide, resistance can be reduced, the noise can be lowered.

Figure 11:
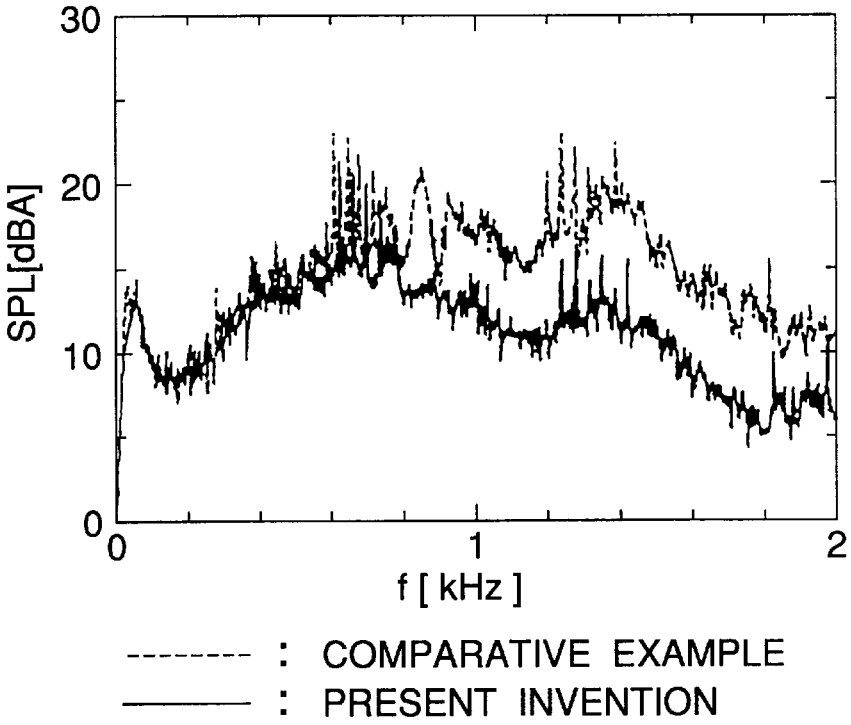
FIG. 11 is a diagram illustrating the results of FFT analysis (frequency analysis) of noise at the same flow rate in an example and the present invention.

As the round starting portion 10*a,* the volute portion 10*b,* and the outlet portion 10*c* are thus formed to form the scroll casing 10, low noise can be attained in a wide frequency region of 800 [Hz] or more as shown in the result of FFT analysis (frequency analysis) of noise at the same flow rate in FIG. 11.

Figure 12:
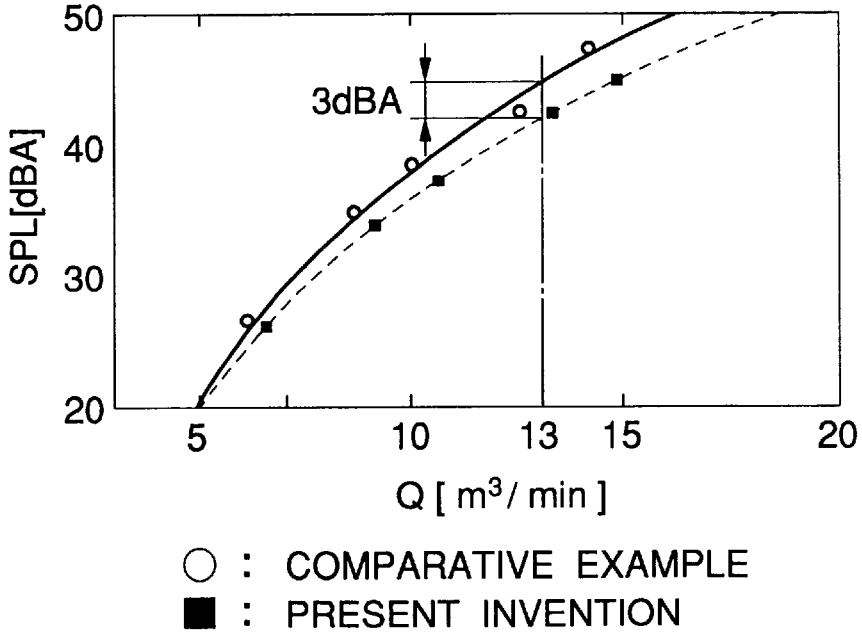
FIG. 12 is a diagram illustrating the relationship of the noise level when the flow rate is varied in the example and the present invention.

In addition, a look at the relationship shown in FIG. 12 on the noise level at the time when the flow rate is varied reveals that the noise is lowered in the overall region as compared with the example. That is, it is possible to obtain a low-noise cross flow fan. It is possible to lower the noise by about 3 [dBA] particularly at the time of a high flow rate when rapid heating is effected.

Second Embodiment

Hereafter, a description will be given of a second embodiment of the present invention with reference to the drawings.

Figure 13:
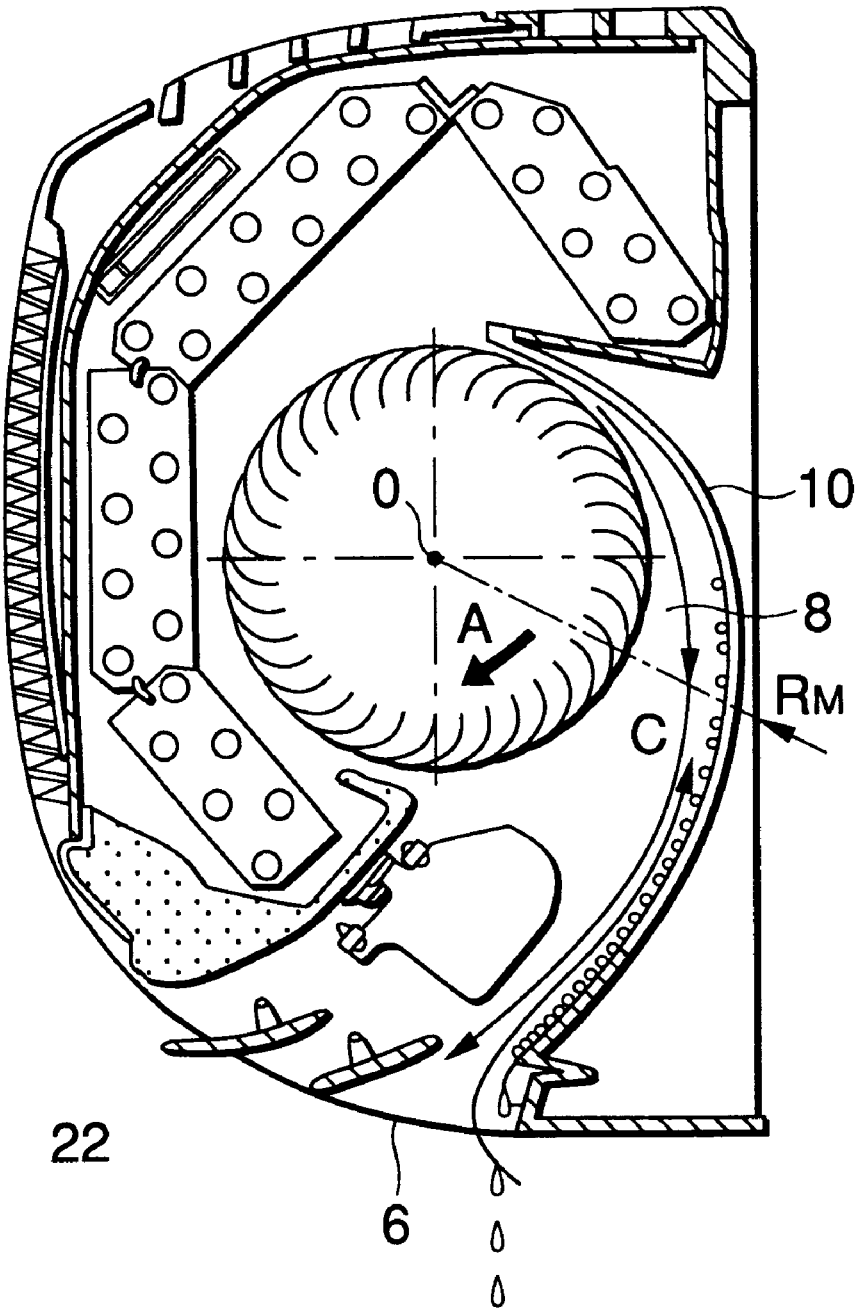
FIG. 13 is a diagram illustrating a state in which hot air of a room flows backwardly from an air outlet during cooling, and dew condenses on the surface of the scroll casing because a maximum volute angle and the maximum volute radius, which indicate the degree of expansion of the volute portion, are excessively large in a second embodiment of the present invention.

FIG. 13 is a diagram illustrating a state in which hot air of the room 22 flows backwardly from the air outlet 6 during cooling, and dew condenses on the surface of the scroll casing 10 because the maximum volute angle $\alpha_M$ and the maximum volute radius $R_M$, which indicate the degree of expansion of the volute portion 10*b,* are excessively large.

If the volute portion 10*b* is too large, slight accumulation of dust on the front air inlet grille 4, the upper air inlet grille 5, the dust removing filter 17, and the air cleaning filter 18 causes the cold blown-out air flow C to become unstable, so that there is a possibility that hot air of the room 22 flows backwardly from the air outlet 6, and dew condenses on the surface of the scroll casing 10, as shown in FIG. 13.

Optimum ranges are present for the maximum volute angle $\alpha_M$ and the maximum volute radius $R_M$, which indicate the degree of expansion of the volute portion 10*b,* so as to obtain a highly reliable air conditioner in which even if dust and the like are accumulated on the filters and other portions, the blown-out air flow C is stabilized and the backward flow does not occur.

Figure 14:
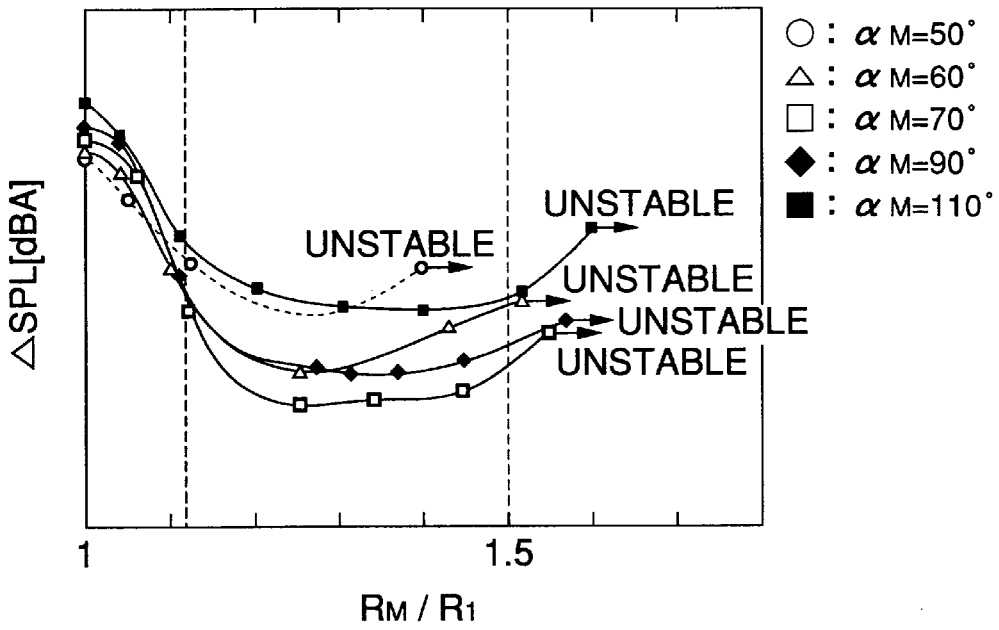
FIG. 14 is a diagram illustrating the change in the noise level at the same flow rate when the maximum volute angle and the ratio between the maximum volute radius and the volute-portion starting radius are varied.

FIG. 14 is a diagram illustrating the change in the noise level at the same flow rate when the maximum volute angle $a_M$ and the ratio $R_M/R_1$ between the maximum volute radius $R_M$ and the volute-portion starting radius $R_1$ are varied.

As illustrated, if $a_M$=60° to 90°, and $R_M/R_1$=1.12 to 1.5×ϕD, it is possible to obtain a low-noise and highly reliable cross flow fan.

Third Embodiment

Referring now to the drawings, a description will be given of a third embodiment of the present invention.

Figure 15:
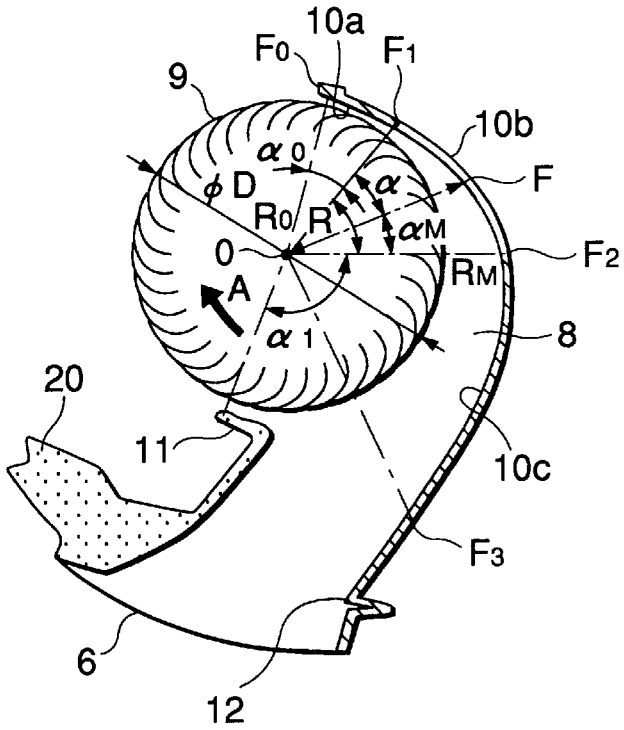
FIG. 15 is a diagram illustrating the cross flow fan in accordance with a third embodiment of the present invention.

FIG. 15 is a diagram illustrating the cross flow fan.

In the drawing, it is now assumed that the outlet-portion starting point, i.e., the terminating point of the volute portion 10*b* and the starting point of the outlet portion 10*c,* is $F_2$, that the volute-portion starting radius, i.e., the length of the segment O–$F_1$ between the center O of the rotating shaft of the impeller and the volute-portion starting point $F_1$, is $R_1$, that the maximum volute radius, i.e., the length of the segment O–$F_2$ at the outlet-portion starting point $F_2$, is $R_M$, that the maximum volute angle, i.e., the angle formed by the segments O–$F_2$ and O–$F_1$, is $\alpha_M$, that an arbitrary point on the volute portion 10*b* is F, that the length of a segment connecting the center O of the rotating shaft and the arbitrary point F is R, and that an angle formed by the segments O–F and O–$F_1$ is $\alpha$. Under this assumption, the volute portion 10*b* is formed into a logarithmically spiral shape satisfying the formula:

$$R=R_1\times\mathrm{EXP}(I_L\times 2\times\pi\times\alpha/360^\circ)$$

where $I_L$ is a scroll expansion ratio; p is the circle ratio; and $0^\circ<\alpha<\alpha_M$.

By forming the volute portion 10*b* in the above-described manner, the volute portion 10*b* bulges more outwardly than in the case of the example scroll casing indicated by the broken lines in FIG. 2, and the portion of the blown-out air flow C where the velocity of air flow is fast does not contact the scroll casing 10 at least in the vicinity of the impeller 9. Therefore, the phenomenon disappears in which the pressure fluctuation P, which occurs due to the impingement of the blown-out air flow C upon the scroll casing 10 in the vicinity of the impeller 9, affects the impeller 9 and aggravates the noise, as shown in FIG. 23. Hence, low noise can be attained.

Optimum ranges are present for the scroll expansion ratio $I_L$ and the maximum volute angle $\alpha_M$, which indicate the degree of expansion of the volute portion 10*b,* so as to obtain a low-noise air conditioner in which even if dust and the like are accumulated on the filters and other portions, the blown-out air flow C is stabilized and the noise does not become aggravated.

Figure 16:
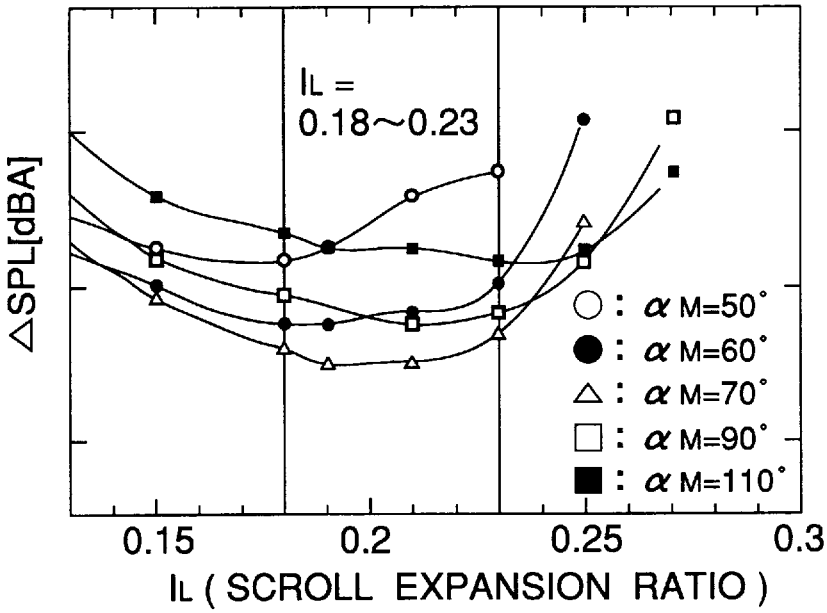
FIG. 16 is a diagram illustrating the change in the noise level at the same flow rate when a scroll expansion ratio and the maximum volute angle have fluctuated.

FIG. 16 is a diagram illustrating the change in the noise level at the same flow rate when the scroll expansion ratio $I_L$ and the maximum volute angle $\alpha_M$ have fluctuated when the volute-portion starting radius $R_1=R_0=\phi D\times 0.54$, for example.

As shown in the drawing, if $I_L$=0.18 to 0.23 and $\alpha_M$=60° to 90°, it is possible to obtain a stable, low-noise, and highly reliable cross flow fan.

Fourth Embodiment

Referring now to the drawings, a description will be given of a fourth embodiment of the present invention.

Optimum ranges are present for the ratio between the outlet-portion starting radius $R_2$ and the outlet-portion terminating radius $R_3$ and the outlet portion angle $\alpha_3$, which indicate the degree of expansion of the outlet portion 10*c,* so as to obtain a low-noise air conditioner in which even if dust and the like are accumulated on the filters and other portions, the blown-out air flow C is stabilized and the noise does not become aggravated.

Figure 17:
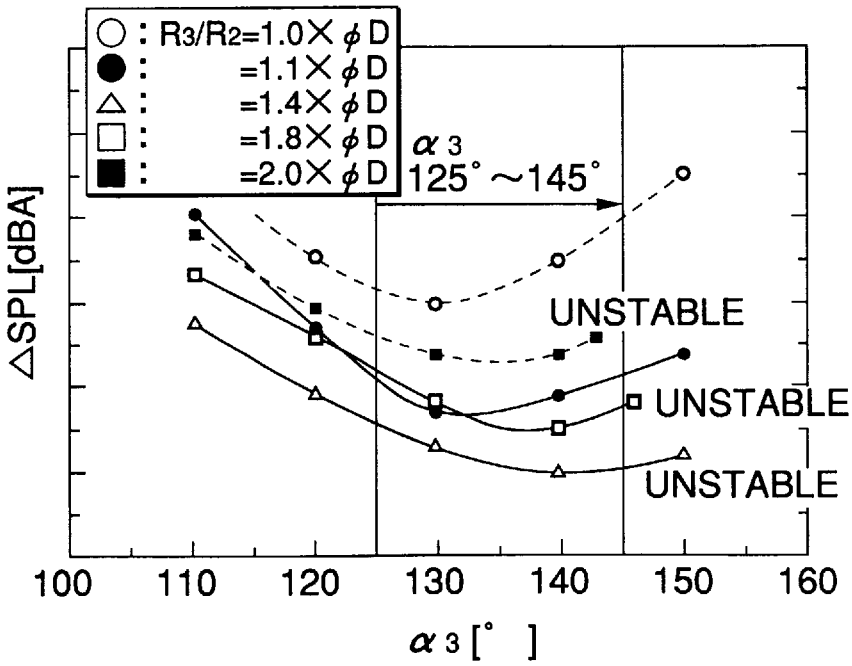
FIG. 17 is a diagram illustrating the relationship between the change in the noise level and the state of the blown-out air flow when the ratio of the outlet-portion terminating radius to the outlet-portion starting radius as well as an outlet portion angle are varied.
Figure 18:
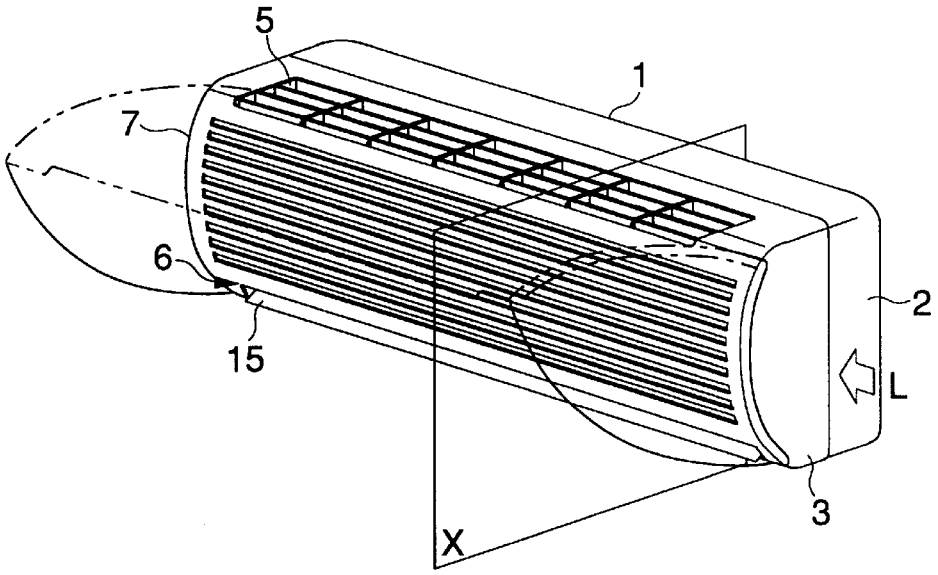
FIG. 18 is a perspective view of the main body of an air conditioner in which an upper air inlet grille is not disposed on the rear surface side of a round starting point of a scroll casing.

FIG. 17 is a diagram illustrating the relationship between the change in the noise level and the state of the blown-out air flow when the ratio $R_3/R_2$ of the outlet-portion terminating radius $R_3$ to the outlet-portion starting radius $R_3$ as well as the outlet portion angle $a_3$ are varied.

As shown in the drawing, if $R_3/R_2$=1.1 to 1.8×ϕD/2, and the outlet portion angle $\alpha_3$=125° to 145°, it is possible to obtain a low-noise cross flow fan in which the blown-out air flow is stabilized.

In the cross flow fan in accordance with the present invention, the phenomenon disappears in which the pressure fluctuation, which occurs due to the impingement of the blown-out air flow C upon the scroll casing in the vicinity of the impeller, affects the impeller and aggravates the noise, so that low noise can be attained.

In addition, by forming the outlet portion such that the passage of the air flow expands toward the air-outlet lower guide, resistance can be reduced, and the noise can be lowered.

What is claimed is:

1. A cross flow fan comprising:

an impeller having a center O of a rotating shaft and a diameter of $\phi D$;

a scroll casing including a round starting portion extending from a round starting point $F_0$ to a volute-portion starting point $F_1$, a volute portion extending from the volute-portion starting point $F_1$ to an outlet-portion starting point $F_2$, and an outlet portion;

a nose section having a stabilizer; and an air inlet disposed outwardly of the round starting point $F_0$, wherein the round starting portion is formed into a circular arc which has the center O of the rotating shaft as its center and in which a round starting angle $\alpha_0$ formed by a segment $O–F_0$ and a segment $O–F_1$ is equal to 15° to 25°, and a round starting radius $R_0$, the round starting radius $R_0$ being a length of a segment connecting the round starting point $F_0$ and the center O of the rotating shaft, is equal to 0.535 to $0.555\times\phi D$, and wherein a length of a segment O–F connecting the center O of the rotating shaft and an arbitrary point F on the volute portion is an arbitrary radius R, an angle formed by the segment O–F and the segment $O–F_1$ is $\alpha$, and a maximum volute angle formed by the segment $O–F_2$ and the segment $O–F_1$ is $\alpha_M$, the volute portion is formed into a logarithmically spiral shape satisfying the formula:

$$R=R_1\times\mathrm{EXP}(I_L\times 2\times\pi\alpha/360°)$$

where $I_L$ (scroll expansion ratio)=0.18 to 0.23; $0<\alpha<\alpha_M$; and $\alpha_M$=60° to 90°.

2. The cross flow fan according to claim 1, wherein the outlet portion has an air-outlet lower guide, and is formed such that a passage of air flow expands toward the air-outlet lower guide.

3. The cross flow fan according to claim 2, wherein an outlet-portion starting radius, the outlet-portion starting radius being a length of the segment $O–F_2$ connecting the center O of the rotating shaft and the outlet-portion starting point $F_2$, is $R_2$, an outlet-portion terminating radius, the outlet-portion terminating radius being a length of the segment $O–F_3$ connecting the center O of the rotating shaft and the outlet-portion terminating point $F_3$, is $R_3$, and an angle $F_2–O–F_3$ is an outlet portion angle $\alpha_3$, the outlet portion is formed into a circular arc wherein $R_2<R_3$, $R_3/R_2$=1.1 to $1.8\times\phi D/2$, and $\alpha_3$=125° to 145°, and the circular arc contacts the air-outlet lower guide at the outlet-portion terminating point $F_3$.

4. A cross flow fan comprising:

an impeller having a center O of a rotating shaft and a diameter of $\phi D$;

a scroll casing including a round starting portion extending from a round starting point $F_0$ to a volute-portion starting point $F_1$, a volute portion extending from the volute-portion starting point $F_1$ to an outlet-portion starting point $F_2$, and an outlet portion extending from the outlet-portion starting point $F_2$ to an outlet-portion terminating point $F_3$;

a nose section having a stabilizer; and an air inlet disposed outwardly of the round starting point $F_0$, wherein the round starting portion is formed into a circular arc which has the center O of the rotating shaft as its center and in which a round starting angle $\alpha_0$ formed by a segment $O–F_0$ and a segment $O–F_1$ is equal to 15° to 25°, and a round starting radius $R_0$, the round starting radius $R_0$ being a length of a segment connecting the round starting point $F_0$ and the center O of the rotating shaft, is equal to 0.535 to $0.555\times\phi D$, and wherein a volute-portion starting radius, the volute-portion starting radius being a length of the segment $O–F_1$ at the volute-portion starting point $F_1$, is $R_1$, a maximum volute radius, the maximum volute radius being a length of a segment $O–F_2$ at the outlet-portion starting point $F_2$, is RM, a maximum volute angle, the maximum volute angle being an angle formed by the segment $O–F_2$ and the segment $O–F_1$, is $\alpha_M$, and a point $F_J$ on the volute portion has a distance to the center O of the rotating shaft equal to $R_J=(R_1+R_M)/2$ and an angle $\alpha_J$ formed by a segment connecting the point and the center O of the rotating shaft and the segment $O–F_1$ is $\alpha_M/2$, and the volute portion is formed into a circular arc wherein $R_1<R_J<R_M$, and the circular arc passes through the points $F_1$, $F_J$, and $F_2$.

5. The cross flow fan according to claim 4, wherein the outlet portion has an air-outlet lower guide, and is formed such that a passage of air flow expands toward the air-outlet lower guide.

6. The cross flow fan according to claim 5, wherein an outlet-portion starting radius, the outlet-portion starting radius being a length of the segment $O–F_2$ connecting the center O of the rotating shaft and the outlet-portion starting point $F_2$, is $R_2$, an outlet-portion terminating radius, the outlet-portion terminating radius being a length of the segment $O–F_3$ connecting the center O of the rotating shaft and the outlet-portion terminating point $F_3$, is $R_3$, and an angle $F_2–O–F_3$ is an outlet portion angle $\alpha_3$, the outlet portion is formed into a circular arc wherein $R_2<R_3$, $R_3/R_2$=1.1 to $1.8\times\phi D/2$, and $\alpha_3$=125° to 145°, and the circular arc contacts the air-outlet lower guide at the outlet-portion terminating point $F_3$.

* * * * *